United States Patent [19]

Bennett et al.

[11] 4,043,410

[45] Aug. 23, 1977

[54] ANTI-STICKING TOOL FOR DRILL PIPE

[75] Inventors: John D. Bennett, Denton; Thomas W. Gallier, Plano, both of Tex.

[73] Assignee: Suntech, Inc., St. Davids, Pa.

[21] Appl. No.: 704,711

[22] Filed: July 12, 1976

[51] Int. Cl.[2] ..... E21B 17/10

[52] U.S. Cl. ..... 175/323; 308/4 A

[58] Field of Search ..... 175/323, 325; 308/4 A

[56] References Cited

U.S. PATENT DOCUMENTS

| | | | |
|---|---|---|---|
| 1,616,666 | 2/1927 | Nebergall | 175/323 |
| 2,368,415 | 1/1945 | Grant | 308/4 A |
| 2,694,551 | 11/1954 | Snyder | 175/323 |
| 2,696,973 | 12/1954 | Baumgartner | 175/323 |
| 2,754,160 | 7/1956 | Owen | 175/323 |
| 3,085,639 | 4/1963 | Fitch | 175/323 |
| 3,164,216 | 1/1965 | Hall, Sr. et al. | 175/323 |
| 3,197,262 | 7/1965 | Fairchild | 308/4 A |
| 3,420,323 | 1/1969 | Owens | 175/323 |

*Primary Examiner*—James A. Leppink

*Attorney, Agent, or Firm*—J. Edward Hess; Donald R. Johnson

[57] ABSTRACT

A tool for use on sections of a drill string which utilizes the "journal bearing effect" to minimize the possibility of the drill string becoming stuck against the side of the wellbore due to differential pressures between the wellbore and the formation. The anti-sticking tool is designed to surround part of a section of the drill string, and to have holes passing therethrough, so that the pressure of the drilling fluids within the wellbore in combination with the rotation of the drill string against the inside surface of the tool causes the drilling fluids to be pushed out through these openings to prevent drill string contact and sticking against the side of the wellbore. The anti-sticking tool can take the shape of a plurality of collars spaced along a drill string section or one continuous helical spring extending part of the length of a section of drill string.

7 Claims, 4 Drawing Figures

ANTI-STICKING TOOL FOR DRILL PIPE

BACKGROUND OF THE INVENTION

This invention is related to an apparatus for minimizing the effects of differential sticking on drill string components and more particularly to an apparatus for minimizing the effects of differential sticking which utilizes the principles of operation of a conventional journal bearing.

In a conventional drilling operation wherein a drill string having a drill pipe and a drill collar with a drill bit on the lower end of the drill collar, is used, the drill string is continuously rotated and drilling fluids, such as drilling mud, are circulated down through the center of the drill string and out through the drill bit to be circulated back to the surface through the annular space between the outside of the drill string and the wellbore boundary to carry the cuttings from the drill bit out of the wellbore. During this drilling operation, the drill string is usually held in tension to control the weight on the bit and the pressure within the wellbore is maintained at a high level due to the flow of drilling mud, the static head or density of the drilling mud.

One problem which is often encountered in such an operation is that a differential pressure in the wellbore is created due to the high pressure of the drilling fluids as compared to the low pressures in the formations in which the wellbore is being drilled. This differential pressure problem is generally reduced by the drilling mud which acts to seal the porous part of the formation around the wellbore. However, in some cases, especially in the more porous formations, the drilling mud does not form a sufficient insulator between the drill pipe and the boundary of the wellbore. Therefore, it is especially important in this situation to maintain continuous rotation of the drill string within the wellbore so that a drilling mud boundary can be provided between the drill pipe and the side of the wellbore. Yet, instances do occur when the rotation of the drill ceases and pipe becomes stuck against the side of the wellbore due to the differential pressures involved. Often times, rotation of the drill pipe or retraction of the drill pipe from the wellbore becomes impossible, resulting in an expensive loss since the entire well is lost.

Many different drill pipe designs have been proposed to eliminate this differential sticking problem. Some drill collars have been made with a square cross section so that the surface area for contacting the side of the wellbore is minimized. Other designs have used spiral flutes formed in the side of the drill string sections to reduce the surface area of the drill pipe subject to differential sticking and to provide more access for the drilling mud to reach the formation behind the drill string section. While these design features may reduce the possibility of differential sticking, the possibility still exists.

SUMMARY OF THE INVENTION

In accordance with a preferred embodiment, an anti-sticking tool for use on a section of a drill string is provided which prevents the drill string from becoming stuck against the wellbore wall because of differential sticking by physically separating the drill string section from the wellbore wall and by having a design feature which causes the drilling mud to be pumped between the tool structure and the wellbore wall so as to reduce the effects of the differential pressures within the wellbore on the drill string.

A first embodiment of the anti-sticking tool utilizes a plurality of cylindrical collars rotatably mounted around the drill pipe with each collar having a plurality of holes passing radially therethrough so that the rotation of the drill pipe within the collar causes drilling mud to be pumped radially outward through these openings in the collar to minimize the differential sticking problems.

A preferred embodiment, however, utilizes a helical spring which extends a predetermined length along the drill string section and has a plurality of openings passing from the inside to the outside of the helical spring so that the rotation of the drill pipe within the spring causes drilling mud to be pumped outward through these openings to minimize the differential sticking problem.

Both of these embodiments utilize the journal bearing principle in which a journal bearing has a mandel rotating in a journal. Considerable pressure is built up between the mandel and the journal, trapping the lubricant or fluid between the mandel and the journal at the point of greatest force. It is the pressure which is derived at this point which is used in the embodiments to force drilling mud outwardly from the collar or spring to force the drill string section away from the side of the wellbore, thereby minimizing the effects of differential sticking.

This anti-sticking tool has several advantages over those systems provided in the prior art. The helical spring design can be easily added to an existing drill pipe or drill collar without material alteration or without complete redesign of the drill pipe or drill collar itself. In addition, the anti-sticking tool design acts in an active manner to minimize the effect the differential sticking by providing a force for displacing the drill string away from the side of the wellbore, as opposed to merely a passive manner, such as having grooves embedded in the side of the drill pipe. No additional forces or power supply means are necessary down hole as the normal rotation of the drill string provides the force that is necessary to make the anti-sticking tool operate properly.

A better understanding of this invention and its advantages can be seen in the following description of the Figures and preferred embodiment.

DETAILED DESCRIPTION OF THE DRAWINGS AND PREFERRED EMBODIMENT

Figure 2:
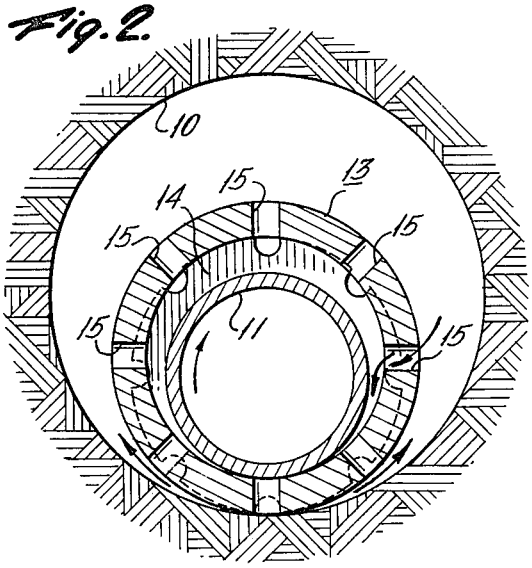
FIG. 2 illustrates a sectional view of the embodiment illustrated in FIG. 1 along the lines 2—2.
Figure 1:
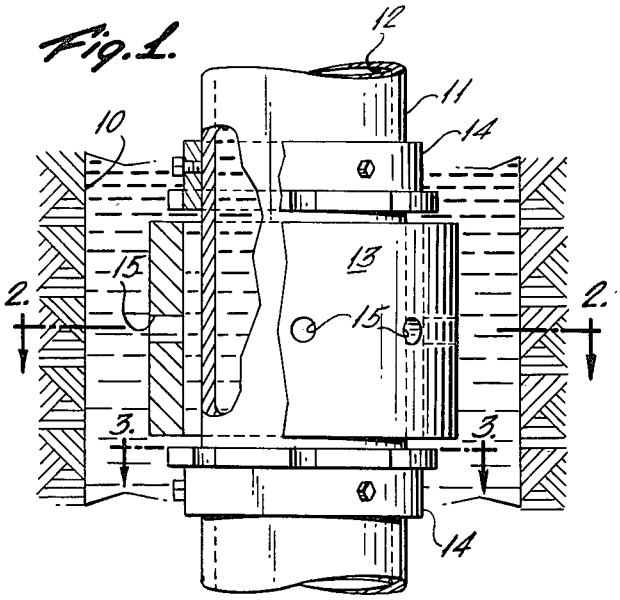
FIG. 1 illustrates one embodiment of the anti-sticking tool which is in the form of a collar surrounding a drill string section.
Figure 3:
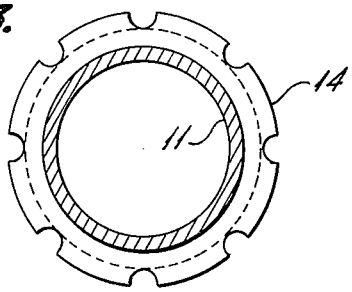
FIG. 3 is a view showing one of the spacers of FIG. 1.

The first embodiment which is directed at minimizing the problem of differential sticking is illustrated in FIGS. 1 and 2. In this embodiment there is a drill string section 11, such as a drill pipe or drill collar, having a center passageway 12 through which the drilling mud can be circulated down to the drill bit. A cylindrical collar 13 is rotatably mounted around the drill pipe 11 and has spacers 14 securely fastened to drill string section 11 to restrict the vertical movement of collar 13. Collar 13 has an inside diameter which is sufficiently greater than the outside diameter of drill string section 11, to form an annular space for drilling mud to be collected in. Spaced around the collar 13 are plurality of openings 15 which pass from the inside wall to the outside wall of collar 13. Spacers 14 are designed to have a plurality of openings spaced around its side so as to permit the flow of drilling mud into the annular space between the drill string section 11 and collar 13. While collar 13 would help reduce the effects of differential sticking by acting as a spacer without the openings, it is preferable to have the openings for better performance, for reasons to be discussed below.

For best results, it is desirable to have a plurality of anti-sticking collars 13 spaced along the entire length of the drill string. In operation, since the drilling mud is under extreme pressure, it seeps into the annular space between collar 13 and drill string section 11. In normal operation when a drill pipe has sufficient space between itself and the inside of the wellbore, the function of anti-sticking collar 13 is not as important. However, in a case where downhole conditions force the drill string section against the side of the wellbore 10, as shown in FIG. 2, thereby creating the possibility of a drill string section becoming stuck against the side of the wellbore because of the differential pressures, the continuous rotation of the drill string anti-sticking collar 13 prevents this sticking from occuring.

While drill string section 11 is continuously rotated, it acts as the journal of a journal bearing causing the drilling mud within the annular space between collar 13 and drill string section 11 to act as a pump to displace the drilling mud out through the openings 15 within drill collar 13 as is illustrated by the arrows in FIG. 2. This pumping action causes a force against the side of the wellbore which acts to reduce the effects of the differential pressures within the formation on the drill string by helping to seal the porous formation as well as to help push the drill pipe away from the side of the wellbore.

Figure 4:
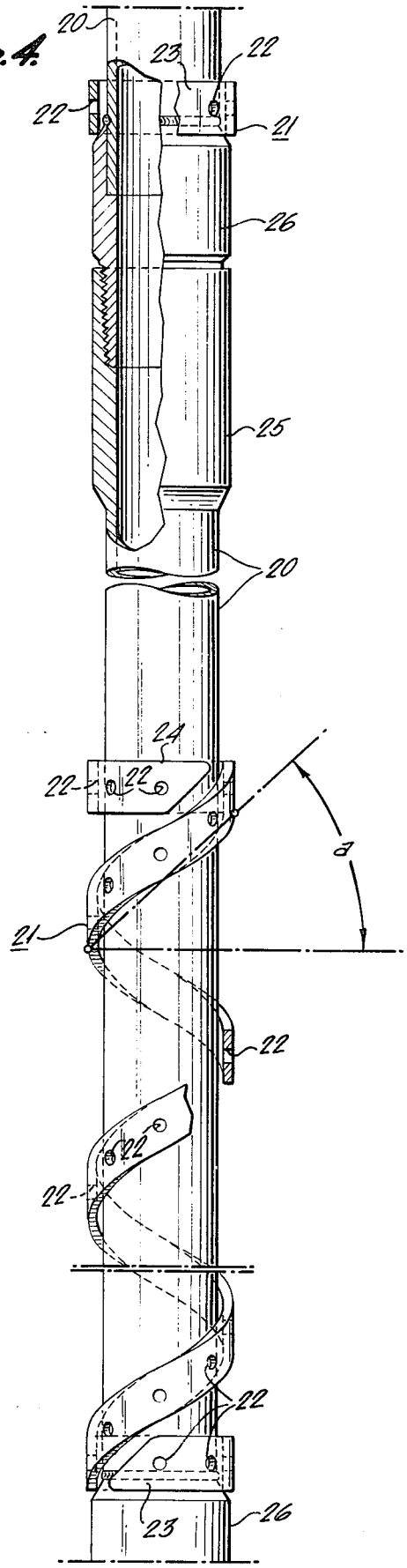
FIG. 4 illustrates a side view of the preferred embodiment of the anti-sticking tool in which the tool is in the shape of a helical spring.

There are many possible designs and configurations for an anti-sticking tool which can take advantage of this journal bearing principle, the collar configuration illustrated in FIGS. 1 and 2 being shown as one example. However, a preferred embodiment is illustrated in FIG. 4. In this embodiment, a drill string section 20 has a helical spring 21 which runs essentially the entire length of the drill string section, leaving enough movement for slip and tong operations. In the case of drill string being 30 feet long, the length of helical spring 21 would preferably be around 24–25 feet. Helical spring 21 is designed to have a plurality of openings 22 spaced along its entire length to provide a flow passage from the inside wall of spring 21 to its outside surface. The spring 21 should be large enough to loosely fit around drill string section 20 in a manner similar to anti-sticking collar 13 illustrated in FIGS. 1 and 2. Preferably, the cross section of the spring 21 is square or rectangular so that the inside surface of the spring is straight in the longitudinal direction and will conform to the outside surface of drill pipe 20. The pitch of the convolutions in spring 21 is preferably between 30° to 45° from horizontal, as is illustrated in FIG. 4 by the angle "a", so as to provide greater longitudinal surface area to permit easier movement within the wellbore as well as to minimize the amount of material necessary to form the spring. The ends of spring 21 can terminate in horizontal convolutions 23, 24 having an inside diameter less than the outside diameter of the drill string joints, 25, 26, as is shown in FIG. 4.

The manner in which spring 21 would function is very similar to that discussed above for collar 13. The pressure of the drilling mud in the wellbore causes the mud to be displaced into the annular space between the drill string section 20 and the inside wall of spring 21 so that it would be available to be pumped through holes 22 due to the rotational motion of the drill string if it is pressed against the inside of spring 21 because of contact against the side of the wellbore. It is this motion which acts as a pump to force liquid or mud out through openings 22, thereby acting to counteract the differential forces being exerted on the drill string 20.

While a particular embodiment of this invention has been shown and described, it is obvious that changes and modifications can be made without departing from the true spirit scope of the invention. It is the intention of the appended claims to cover all such changes and modifications.

The invention claimed is:

1. An anti-sticking tool for use with a drill string in a wellbore subject to differential pressures from the pressurized drilling mud and the wellbore formation, great enough to cause a section or sections of a drill string to become stuck against the side of the wellbore, comprising:

a. means, rotatably mounted, for surrounding a predetermined portion of the drill string, so that upon rotation of the drill string section when it is resting against part of the inside of said surrounding means, drilling mud within the wellbore is displaced inside the space between the drill string section and the surrounding means to provide lubrication between the two objects and to maintain the drill string section away from the wellbore wall, thereby minimizing the effect of the differential pressures upon the drill string section;

b. said surrounding means also having a plurality of openings passing therethrough from its inside wall near the drill string section to its outside wall, so that when the drill string section is pressed against part of the inside wall of the surrounding means due to differential pressures in the wellbore, rotation of the drill string causes drilling mud to be pumped through these openings from the inside wall to the outside wall, thereby reducing the effects of differential pressures; and c. means for restricting the movement of the surrounding means along the longitudinal axis of the drill string.

2. The apparatus recited in claim 1 wherein the surrounding means is rigid collar having a cylindrically shaped inner surface area surrounding the drill pipe and having an inside diameter sufficiently greater than the outside diameter of the drill pipe to create an annular space to retain drilling mud.

3. The apparatus recited in claim 2, wherein the rigid collar has a plurality of openings passing therethrough from its inside wall near the drill string section to its outside wall, so that when the drill string section is pressed against part of the inside wall of the rigid collar due to differential pressures in the wellbore, rotation of the drill string causes drilling mud to be pumped through these openings from the inside wall to the outside wall, thereby reducing the effects of differential pressures.

4. Apparatus recited in claim 1 wherein the surrounding means is an elongated helical spring surrounding a drill string section.

5. The apparatus recited in claim 4, wherein the helical spring has a plurality of openings passing therethrough from its inside wall near the drill string section to its outside wall, so that when the drill string section is pressed against part of the inside wall of the helical spring due to differential pressures in the wellbore, rotation of the drill string causes drilling mud to be pumped through these openings from the inside wall to the outside wall, thereby reducing the effects of differential pressures.

6. Apparatus recited in claim 5, wherein the angle of the convolutions of the spring, as measured from a line perpendicular to the longitudinal axis of the spring, is from 30° to 50°.

7. Apparatus recited in claim 6, wherein the ends of the helical spring are formed by horizontal convolutions.

* * * * *